US010295317B2

(12) United States Patent
Browning

(10) Patent No.: US 10,295,317 B2
(45) Date of Patent: May 21, 2019

(54) DEVICE AND METHOD FOR SIMULATING THE WEIGHT OF A LOADED GUN MAGAZINE

(71) Applicant: Peter M. Browning, Savannah, GA (US)

(72) Inventor: Peter M. Browning, Savannah, GA (US)

( * ) Notice: Subject to any disclaimer, the term of this patent is extended or adjusted under 35 U.S.C. 154(b) by 0 days.

(21) Appl. No.: 16/020,786

(22) Filed: Jun. 27, 2018

(65) Prior Publication Data

US 2019/0025029 A1 Jan. 24, 2019

Related U.S. Application Data

(60) Provisional application No. 62/535,396, filed on Jul. 21, 2017.

(51) Int. Cl.

| | |
|---|---|
| ***F42B 8/08*** | (2006.01) |
| ***F41A 9/71*** | (2006.01) |
| ***F41A 9/65*** | (2006.01) |
| ***F41A 33/00*** | (2006.01) |

(52) U.S. Cl.

CPC ..... *F42B 8/08* (2013.01); *F41A 9/65* (2013.01); *F41A 33/00* (2013.01); *F41A 9/71* (2013.01)

(58) Field of Classification Search

CPC .... F42B 8/08; F42B 33/00; F41A 9/70; F41A 9/71

See application file for complete search history.

(56) References Cited

U.S. PATENT DOCUMENTS

| | | | | |
|---|---|---|---|---|
| 2,396,816 A * | 3/1946 | Boudreau | F41A 9/71 | 42/49.02 |
| 4,888,899 A * | 12/1989 | Chesnut | F41A 9/70 | 42/50 |
| 5,689,907 A * | 11/1997 | Cooley | F41A 9/61 | 42/1.01 |
| 8,028,455 B1 * | 10/2011 | Battaglia | F41A 9/71 | 42/49.02 |
| 9,182,189 B2 | 11/2015 | Seigler | | |

(Continued)

OTHER PUBLICATIONS

"How Much Does Your Ammo Weight?", https://www.thefirearmblog.com/blog/2008/09/29/2-bore-rifle-photos/2019/ (Year: 2016).*

(Continued)

*Primary Examiner* — Joshua T Semick

(74) *Attorney, Agent, or Firm* — John G. Posa; Belzer PC

(57) ABSTRACT

A weighted body adapted for insertion into an existing gun magazine shell approximates the weight and/or density of live ammunition cartridges. The size and shape of the body allows for insertion down and into the slot at the top on the magazine, pressing down on the spring, with a sliding retainer stop or other feature to maintain the weight in position, filling or partially filling the internal volume of the magazine with the weight. The integral slide retainer stop attached at the top of the device is then moved or slid by the operator into a position that locks the weight into the magazine so it cannot pop back out due to spring pressure and will not interfere with other workings of the gun slide or receiver. A plurality of color-coded stops may be provided for use with the same or different weighted bodies corresponding to different calibers of ammunition.

15 Claims, 4 Drawing Sheets

(56) References Cited

U.S. PATENT DOCUMENTS

| | | | | |
|---|---|---|---|---|
| 9,423,221 | B2 * | 8/2016 | Bonner | F42B 8/08 |
| 9,488,426 | B2 * | 11/2016 | Ladner | F41A 9/71 |
| 10,041,752 | B2 * | 8/2018 | Ladner | F41A 9/70 |
| 2016/0245610 | A1 * | 8/2016 | Schulz | F41A 33/00 |
| 2017/0307319 | A1 * | 10/2017 | Jarboe | F41A 9/71 |

OTHER PUBLICATIONS

"True Weight Guns & Magazines", https://www.alternateforce.net/bluegun-trueweight.html (Year: 2009).*

* cited by examiner

DEVICE AND METHOD FOR SIMULATING THE WEIGHT OF A LOADED GUN MAGAZINE

REFERENCE TO RELATED APPLICATIONS

This application claims the benefit of and priority to U.S. Provisional Patent Application Ser. No. 62/535,396, filed Jul. 21, 2017, the entire content of which is incorporated herein by reference.

FIELD OF THE INVENTION

This invention relates generally to pistols or rifles that accept magazines as a source of ammunition. More specifically, the invention resides in devices and methods for simulating the weight of live ammunition by replacing the live ammunition with a weighted device for the purpose of training in gun handling.

BACKGROUND OF THE INVENTION

It is important to learn, understand and train in the proper and safe handling of firearms. Aware of the dangers associated with handguns and rifles, gun owners typically empty the weapon to assure the chamber is clear before handling the gun. However, the cartridges that are used in these guns are manufactured for live fire with materials that have considerable weight. Gun magazines hold a considerable number of cartridges, with the weight of a fully loaded magazine being several ounces heavier than when unloaded.

When the cartridges are removed from the magazine, the weapon is lighter in weight, and this limits the experience of the training operation. Indeed, the unloaded weapon is so much lighter in training as compared to a fully loaded condition that the operator will be unaccustomed to the feel of the gun when the situation arises for the weapon to be fully loaded. In short, the muscle memory learned during training and handling will be incorrect.

A variety of devices exist that allow for the handling of unloaded weapons for so-called "dry fire" operations, wherein the operator aims and pulls the trigger for training purposes. The prior art allows for the pulling of the trigger and cycling and, in some cases, a dummy cartridge may be placed in the chamber for the firing pin to strike without a bullet being fired. Again, however, the muscle memory learned from handling and training loaded guns is not achieved.

An alternative training technique may include leaving live cartridges in the magazine but not in the chamber and simply not cycling a cartridge into the chamber to simulate the actual weight of the loaded gun. This is a serious safety issue, however, as the trainee may mistakenly chamber a cartridge and create a severe hazard to anyone nearby.

Both pistol and rifle magazines utilize an internal spring that creates an upward pressure on the cartridges, urging them into position inside the chamber of the gun. When the slide device on the gun is drawn back and released and placed into battery or cycled, a round of ammunition is pushed upwards into the chamber of the barrel and thus prepared to be fired.

SUMMARY OF THE INVENTION

This invention resides in a method and apparatus for reproducing the experience of a loaded magazine when, in fact, the weapon is not loaded and is completely safe. The invention employs a heavy and/or dense material selected to approximate the similar weight and/or density of live ammunition cartridges. The size and shape of the invention allows for the insertion down and into the spring-loaded magazine slot at the top on the magazine, which is then retained in the magazine by a sliding retainer stop.

The weighted body is inserted into the existing gun magazine, pressing down on the spring, filling or partially filling the space within the magazine shell. The integral slide retainer stop, coupled to the top of the device, is then moved or slid by the operator into a position that locks the weight into the magazine so it cannot pop back out due to spring pressure and will not interfere with other workings of the gun slide or receiver, thereby facilitating dry firing of the weapon.

DETAILED DESCRIPTION OF THE PREFERRED EMBODIMENTS

Reference is now made to the accompanying drawings, wherein like numerals indicate like or corresponding parts throughout the several views.

Figure 1:
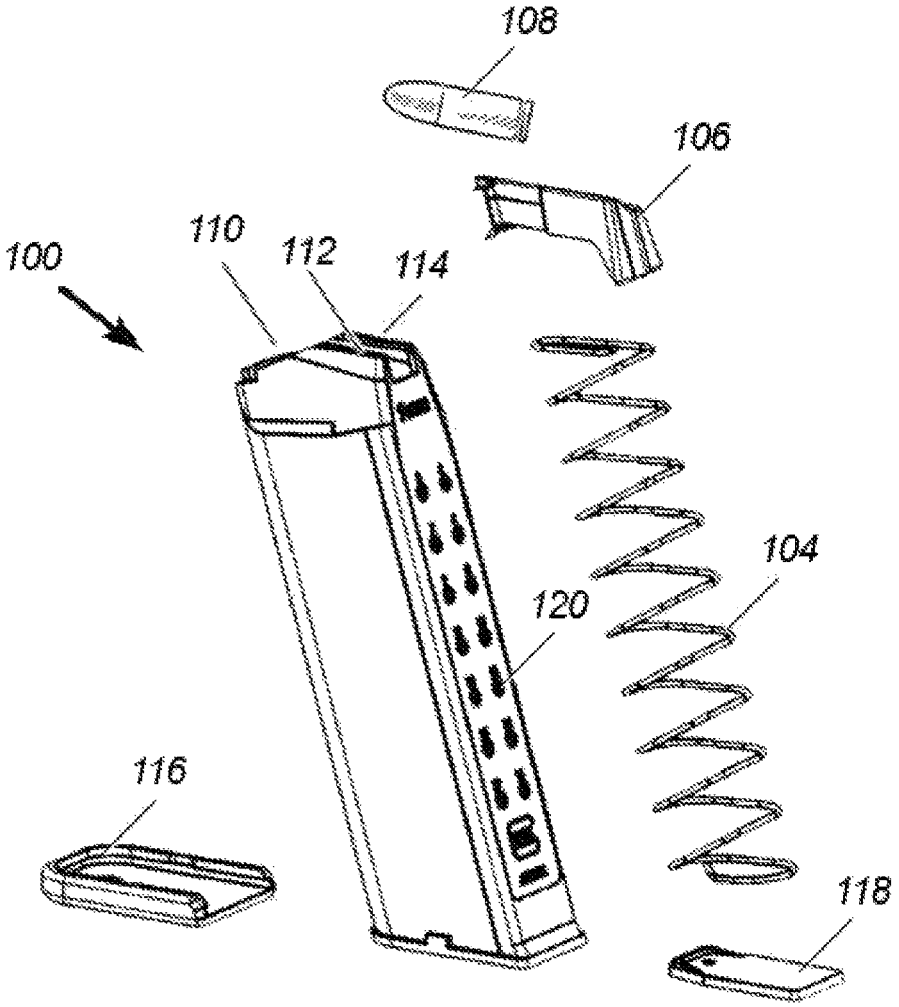
FIG. 1 is an exploded view of an existing pistol magazine.

FIG. 1 is an exploded view of a typical magazine 100 of the type used in pistols and rifles. Those of skill in the art will appreciate that the magazine depicted in FIG. 1 is simplified and/or generic, and that numerous other magazine styles are available, including curved designs. Further, the elements depicted in this, and the other drawings accompanying this description, are not necessarily to scale The magazine assembly of FIG. 1 includes an outer shell 102, usually of hardened steel, that contains a spring 104 and a follower 106. The magazine is loaded by inserting cartridges 108 into top opening 110, applying pressure to follower 106 and compressing spring 104. In normal live fire exercises, the magazine is then inserted into the gun, and the spring action urges each cartridge upwardly, to be retained by captures 112, 114 on either side of a narrower slot. A mechanism in the gun slide includes an element (302 in FIG. 3C) that moves forwardly in the slot between the captures and transfers the uppermost bullet in to the chamber for firing. After each shot, the shell is ejected, and a new round is pushed out opening 110 into the barrel of the gun.

The inside of the magazine is also typically accessible from the bottom by removing lock plate 116 and base plate 118. Apertures 120 on the side of the shell may be provided to show the rounds present in the magazine. In the illustrated device, the cartridges are arranged in double rows, with two windows per level, though the invention may be used with any form of stacking in the magazine, including single stacking.

Figure 2:
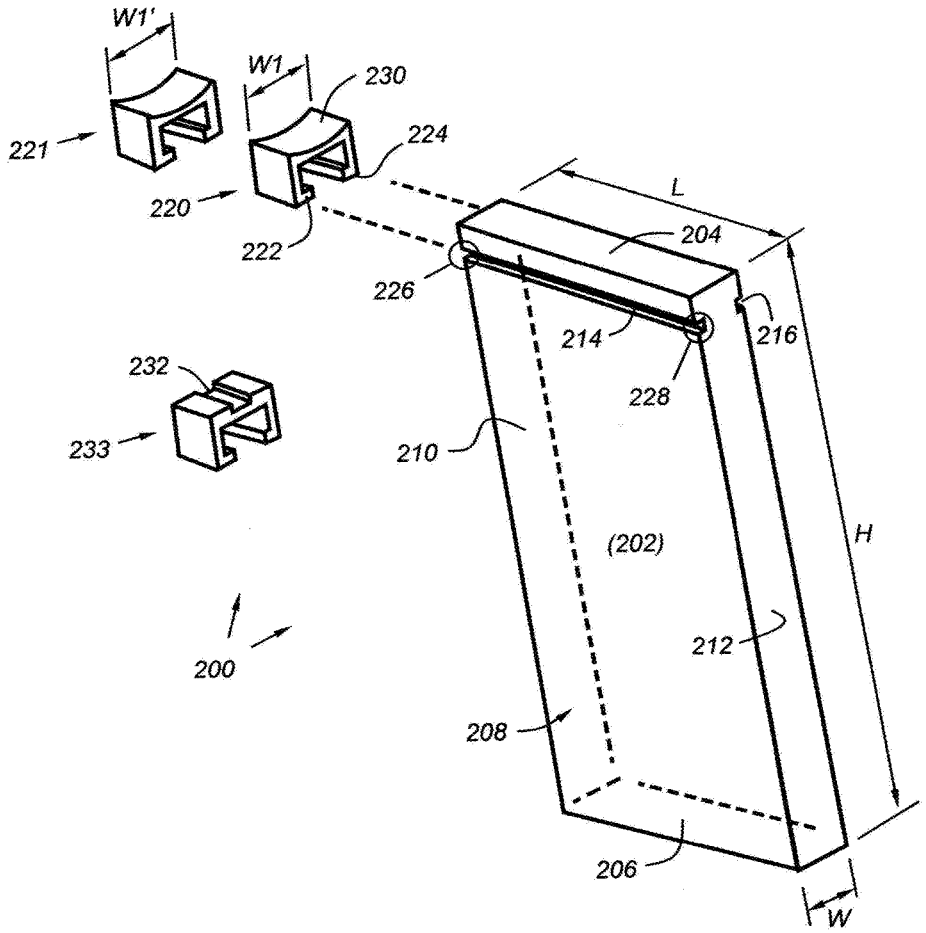
FIG. 2 is an oblique view of a preferred embodiment of the invention with retainer stops uncoupled from a track.

FIG. 2 is a drawing of an embodiment of the invention, depicted generally at 200. Broadly, the device comprises a body 202 that simulates the weight of the rounds in a loaded magazine. The inventive device is inserted into an existing magazine shell through the top opening, thereby essentially replacing the bullets, while retaining the use of the existing magazine shell. This has numerous advantages; for one, the shooter can use whatever magazine they are accustomed to, rather than purchasing a weighted magazine for a particular weapon. Further, since the same weighted body 202 many be used in many different weapons, this reduces the number of devices that a user needs to have on hand for dry firing and training practice with different guns.

Continuing the reference to FIG. 2, the weighted body 202 has a length, L, a width, W, and a height, H. These dimensions define a top surface 204, a bottom surface 206, two side surfaces 208 (only one of which is visible in this figure), a front surface 210, and a back surface 212. The top and bottom surfaces may be generally parallel to one another, and the sides 208 may be parallelograms for better conformity with the shape of the gun magazine; that is, the top and bottom surfaces may be at non-90-degree angles relative to the front and back surfaces, as perhaps best seen in FIG. 3. The bottom surface may be flat, or may be contoured to cooperate with the top surface of the follower in the magazine.

The upper portion of the weighted body 202 includes opposing lengthwise grooves or channels 214, 216 configured to receive a retainer stop 220 with opposing, inwardly facing side tabs 222, 224 that engage with the grooves or channels 214, 216, thereby enabling the retainer stop 220 to slide from front to back on the top of the body. The grooves may either be open at the front and back, enabling the stop 220 to easily slide on an off, or the body 202 may have material at ends 226, 228 on one or both sides of the body to keep the retainer stop 220 engaged in the channels 214, 216. While the preferred embodiment includes opposing channels on the weighted body and opposing, inwardly directed tabs that cooperate with the channels, the invention anticipates any insertable or moveable stop that keeps the weighted body from popping out.

The invention may be provided with a single retainer stop 220. However, in the preferred embodiment, a plurality of stops are provided with different widths for different caliber ammunition. FIG. 2 shows one stop 220 having a width W1, and an alternative stop 221 having a different or larger width W1'. Also in the preferred embodiments, the top of each stop may have a front-to-back or lengthwise concavity 230 to ensure that the bullet transfer mechanism in the gun "misses" the stop, allowing for unimpeded dry firing. As opposed to a smooth concavity, a groove 232 may instead be used as shown in stop 233.

The stops may be rigid and made of metal or hard plastic, for example, if they are configured to slide on and off the top of the body 202. However, if material is provided at the ends 112, 228 of the channels 214 and/or 216, the stops would instead preferably be made from a flexible, resilient plastic such as nylon, or the like, so that jaws of one stop may be flexed for removal, with the jaws of a replacement stop being flexed open for mounting on the body.

Figures 3A, 3B, 3C:
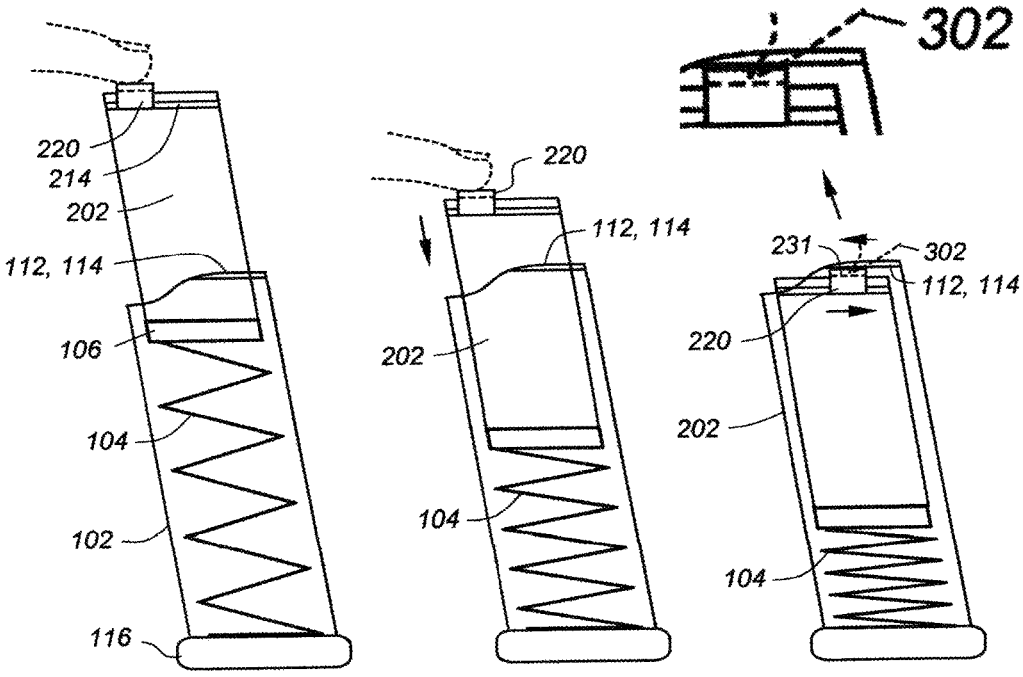
FIG. 3A shows an inventive weight being pressed into a magazine shell against a spring.
FIG. 3B continues the process of FIG. 3A, further compressing the spring internal to the magazine shell.
FIG. 3C shows the weighted body fully inserted into the shell, with the retainer stop being pushed under opposing captures, locking the weight into position.

In use, the weighted body 202 is pressed downward into a magazine shell, as shown in FIG. 3, thereby depressing the spring downwardly, and creating resistance force, as with bullet loading. FIG. 3A shows the weight 202 being initially pressed into a magazine shell 102 against spring 104. FIG. 3B continues the process of FIG. 3A, further compressing the spring internal to the magazine shell, and FIG. 3C shows the weighted body fully inserted into the shell, with the retainer stop being pushed under opposing captures 112, 114, thereby locking the weight into position within the shell 102. The user may press against the retainer stop 204 during insertion of weighted body 202 into the magazine shell.

Again, once the weighted body 202 has been pressed sufficiently deep into the magazine shell, the retainer stop 204 is pushed through opening 110, and then slid rearwardly on the weighted body 202 so as to be positioned under the narrower captures 112, 114 of the magazine shell, thereby locking the weighted body 202 into the existing magazine assembly. Once the body 202 is locked in place, the magazine is now safe to place into the weapon, allowing for the training in the handling of the weapon with a simulated weight as if loaded.

As shown in FIG. 3C, the top, central surface 231 of retainer stop 220 is recessed from front to back to ensure that the gun's ratcheting mechanism 302 used to transfer the bullet at the top of the magazine into the chamber for firing does not interfere with the top the retainer stop 220 once the weighted body is in position. As mentioned, this facilitates dry-firing of the weapon. That is, the user can "rack" the slide and dry fire the gun without interference. Such "racking" of the slide is an important training activity, as it allows the user to practice clearing the chamber in the event of a misfire or no-fire round.

Figure 4A:
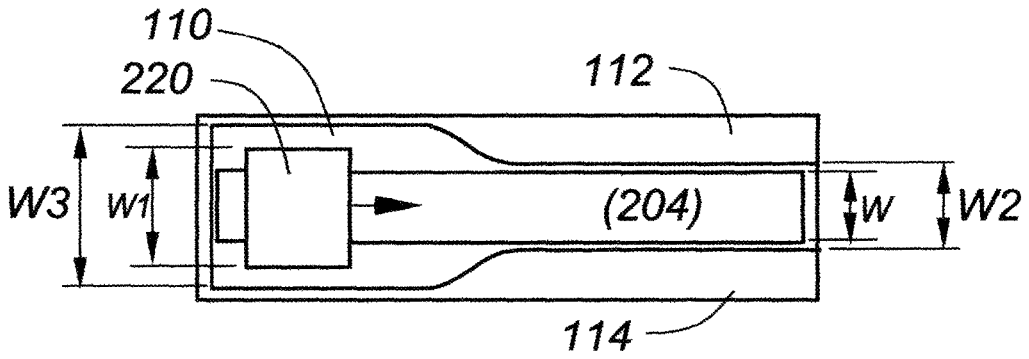
FIG. 4A is a top view of a weighted body in a magazine shell with relative dimensions prior to setting the retainer stop.
Figure 4B:
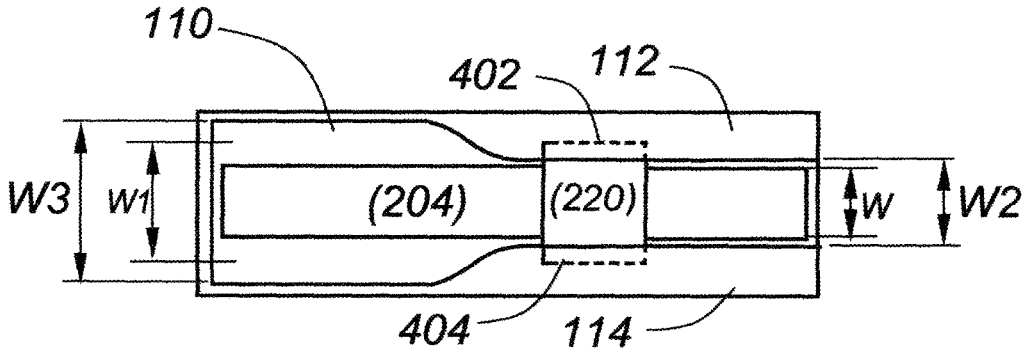
FIG. 4B is a top view of a weighted body in a magazine shell after setting the retainer stop.

FIG. 4A is a top view of a weighted body in a magazine shell with relative dimensions prior to setting the retainer stop, and FIG. 4B is a top view of a weighted body in a magazine shell after setting the retainer stop. As shown in FIG. 4A, the width W of the weighted body is less than the width W2 of the slot between captures 112, 114, such that the entire body can slide into the magazine shell. The width of the stop, W1, is less than the width W3 of the opening 110, but greater than the width W2 between the captures. As such, when the stop 220 is slid under the captures, overlapping portions 402, 404 keep the body from being pushed out by the compressed spring in the magazine shell. The stop 220 may be slid under the captures 112, 114 at different front-to-back positions so long as the weighted body remains secured in the shell. The side surfaces of the body 202 will typically not touch the inner side surfaces of the shell during insertion, though the front and back surfaces of the weight may slide against the inner front and back surfaces of the shell.

Different retainer stops may be color-coded and sized in terms of width to indicate different calibers bullets. For example, one color stop may be used for 9-mm ammunition, with the width W1 of the stop being sized for retention under the captures 112, 114 of a magazine used for 9-mm bullets. A different color stop 221, with a slightly larger width W1', may be used for 45-caliber ammo, and so forth. Advantageously, the same weighted body may be used for different magazines for different caliber ammo by simply changing the body. Indeed, assuming the width W between the captures for a 9-mm bullet is the "smallest" width in a range of bullet sizes, a weighted body configured for a 9-mm magazine may be used in a variety of larger magazines by simply changing the retainer stop(s). That is, by changing the retainer stop, the same weighted body can be used in any magazine that accepts 9 mm, 10 mm, 40 cal, 380 auto, 45 ACP, etc.

The weighted body 202 may be milled, cast or otherwise fabricated from a solid piece of material such as lead, though other materials such as antimony, nickel, tin, etc., may alternatively be used, including alloys and even more exotic materials such a depleted uranium. Alternatively, the body 202 may be hollow and filled with weighted powder or shot composed of these or other materials. While the primary goal of the invention is to simulate the weight of a loaded magazine, for improved muscle memory training, it may also be important to place the center of gravity of the weighted body at the same center of gravity as might be experienced with a loaded magazine. As such, in alternative embodiments of the invention it may be advantageous to vary or gradually increase or decrease the weight of the body from top to bottom. For example, with a "short" body 202, the weight may be concentrated toward the bottom of the body.

The weighted body 202 may be narrow, to simulate a single column of bullets in a magazine, or wider to simulate double rows, as illustrated with the magazine 100 in FIG. 1, so long as the weighted body approximates the weight of the rounds that would otherwise occupy a given magazine shell. Longer versions may also be provided for larger hand guns that use extended magazines. Those of skill in the art will further appreciate that ammunition weights are well known and available to the public. See, for example, http://www.thefirearmblog.com/blog/2016/04/09/how-much-does-your-ammunition-weigh/, the entire content of which is incorporated herein by reference.

Using 9 mm ammo as one example of many, the lightest round in the table is about 0.272 oz., whereas the heaviest is around 0.450 oz. The magazine for a Glock 19 accepts 16 (double stack) rounds, so the range in loaded magazine weight is about 4.352 to 7.2 ounces. The average weight between the heaviest and lightest 9 mm round according to the table is about 0.36 oz. (i.e., 0.450 oz.+0.272 oz./2=0.361 oz.) per round. Thus, the average weight of a Glock 19 magazine loaded with 16 bullets is about 5.7 ounces.

Similar calculations can be made for any type of magazine accepting any number of rounds. For example, again using 9 mm as an example, a single stack embodiment of the invention would weigh about 4.5 oz., or about 12.5 rounds, which accurately approximates the weight of most fully loaded single-stack magazines. Lighter magazines, for small, personal carry guns concealed weapons like the .380, would weigh about 3.9 oz., mimicking 10.83 rounds using that same average weight which again is full capacity for many magazines.

Given the above examples, the following weighted bodies represent one range of possibilities according to the invention:

3.9 oz. —Single stack conceal carry (short)
4.5 oz. —Single stack
5.7 oz. —Double stack Again, the above numbers represent average weight of a loaded magazine of a particular caliber (9 mm), with the understanding that different weights are clearly anticipated by the invention with respect to different types of rounds, including partially filled magazines.

The invention claimed is:

1. An article for simulating the weight of ammunition adapted for insertion into an existing gun magazine having an outer shell with a top opening for inserting the ammunition against a follower and an internal spring disposed within the magazine shell, and wherein the existing gun magazine is adapted for insertion into the bottom of gun handle, the article comprising:

a weighted body with a top, a bottom a length, front and back surfaces and opposing side surfaces;

wherein the weighted body is dimensioned for insertion into the existing magazine shell through the top opening thereof, thereby compressing the follower against the spring within the existing magazine shell;

wherein the top of the weighted body includes a device to maintain the body within the existing magazine shell once inserted;

wherein the device used to maintain the body within the existing magazine shell is a retainer stop that moves from front to back on the top of the weighted body; and wherein the weighted body contains no ammunition but has a predetermined weight corresponding to the weight of the ammunition adapted for insertion into the same existing magazine shell.

2. The article of claim 1, wherein the weighted body is a unitary body from a single piece of metal or other material.

3. The article of claim 1, wherein the weighted body is a hollow body filled with powder or particles.

4. The article of claim 1, wherein the weighted body is shaped as a generally rectangular slab.

5. The article of claim 1, wherein the weighted body has a predetermined weight in the range of 3 to 5 ounces.

6. The article of claim 1, wherein the weighted body has a predetermined weight in the range of 3.5 to 5.5 ounces.

7. The article of claim 1, wherein the weighted body has a predetermined weight in the range of 4 to 6 ounces.

8. The article of claim 1, wherein the weighted body has a predetermined weight in the range of 4.5 to 6.5 ounces.

9. The article of claim 1, wherein the weighted body has a predetermined weight in the range of 5 to 7 ounces.

10. The article of claim 1, wherein the predetermined weight of weighted body corresponds to all of the rounds of ammunition that would otherwise fit into the existing shell.

11. The article of claim 1, wherein: the upper opening in the existing shell includes a front portion with a width (W3) and a rear portion with a width (W); and wherein the width of the retainer stop is less than W3 but greater than W.

12. The article of claim 11, wherein:

the upper portion of the weighted body includes opposing front-to-back slots, grooves or channels; and retainer stop includes inwardly directed tabs that cooperate with the slots, grooves or channels.

13. The article of claim 11, wherein the retainer stop may be removed and replaced with one or more different stops enabling the weighted body to be installed in magazines designed for different calibers of ammunition.

14. The article of claim 13, including one or more different stops that are color-coded.

15. The article of claim 11, wherein:

the existing magazine is adapted to be received in a weapon equipped with a cycling slide mechanism that transfers the ammunition from the magazine to the chamber for firing; and the top of the retainer stop includes a depression, groove or concavity that does not interfere with the cycling of a slide mechanism, thereby facilitating dry firing of the weapon.

* * * * *